United States Patent [19]

Shaw

[11] Patent Number: 4,686,882

[45] Date of Patent: Aug. 18, 1987

[54] EXPANDIBLE AND COLLAPSIBLE ACOUSTIC GUITAR

[76] Inventor: Eric D. Shaw, 29300 Routt County Rd. #14, Steamboat Springs, Colo. 80487

[21] Appl. No.: 831,334

[22] Filed: Feb. 20, 1986

[51] Int. Cl.[4] ..... G10D 1/08

[52] U.S. Cl. ..... 84/291; 84/293

[58] Field of Search ..... 84/173, 267, 291, 293

*Primary Examiner*—Lawrence R. Franklin

[57] ABSTRACT

An acoustic guitar has a folding, collapsible body and a folding neck for providing acoustic sounds from an easily stored instrument. The body has two hinged wings which telescope over a central body portion. The neck is hinged to the body to fold over the soundboard portion of the body.

17 Claims, 11 Drawing Figures

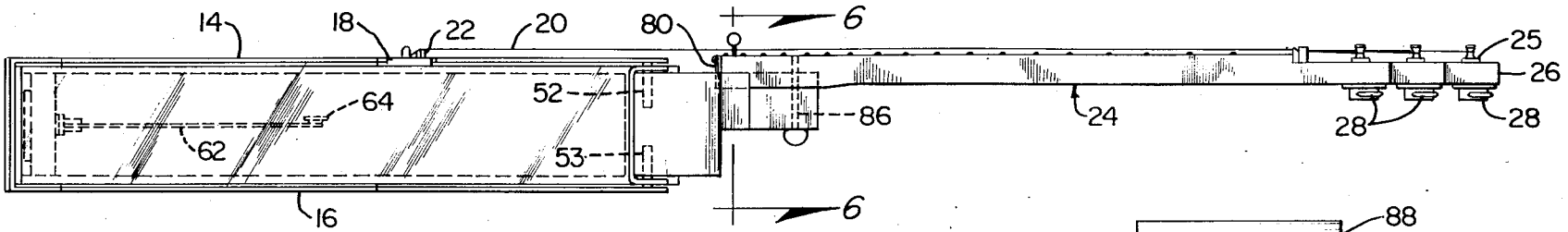
4
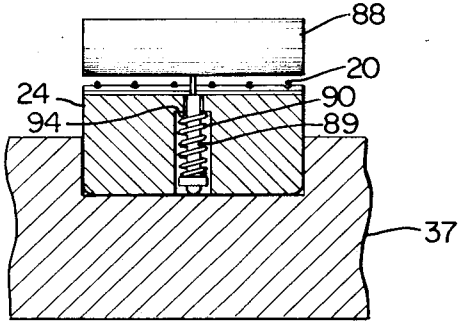
6
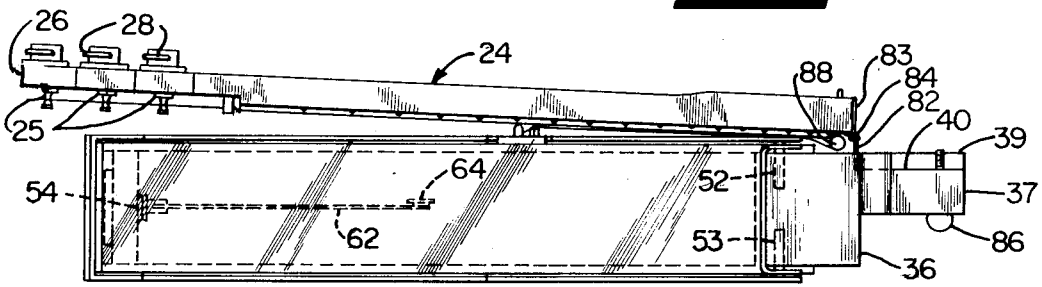
5
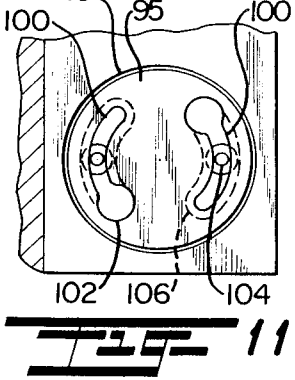
11
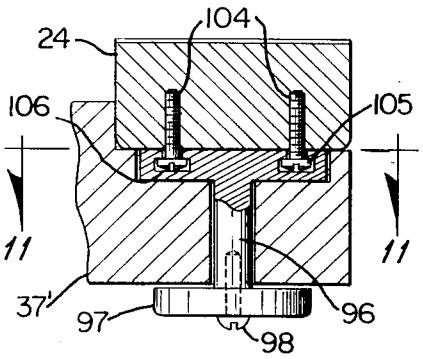
10
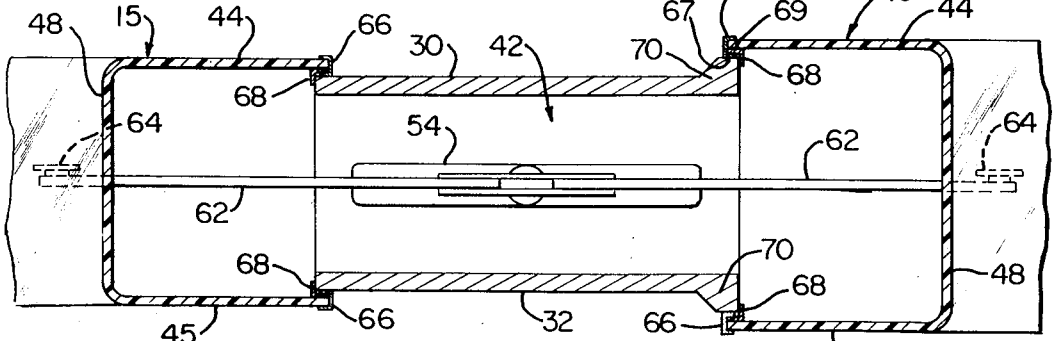
7

EXPANDIBLE AND COLLAPSIBLE ACOUSTIC GUITAR

This invention relates to stringed musical instruments; and more particularly relates to a novel and improved acoustic guitar which is collapsible from the size of a standard guitar into an extremely compact unit when not in use.

BACKGROUND AND FIELD OF THE INVENTION

As in the case of many musical instruments, acoustic guitars and many other of the larger stringed instruments present major problems with respect to their storage and transportation. Although many of the musical instruments can be easily taken apart and stored in a relatively small case for ease of carrying or handling, the same has not been true of the larger stringed instruments, such as, the acoustic guitar which includes a relatively large sound chamber to enhance the sound or tonal characteristics of the instrument.

It has been proposed in the past to design guitars so as to be collapsible or of reduced size for greater ease of carrying or transportation as well as to be able to store in a compact condition particularly for those living in confined living areas. One approach has been to construct the guitar with a foldable neck or fingerboard portion, a representative approach being that disclosed in U.S. Pat. No. 4,073,211 to A. C. Jorgensen which utilizes a hinged arrangement with a shaped recess on the back of the instrument to receive the neck in the collapsed position. In Jorgensen, the bridge also can be detached for storage purposes. U.S. Pat. No. 4,111,093 to R. Field et al employs a somewhat complex system of gears and rollers so that the tension on the strings can be relaxed in order to permit the neck to be folded and employs a spring-loaded pin for the purpose of locking the neck in an extended position when the instrument is to be played.

To the best of my knowledge, however, no one has devised an acoustic guitar which combines the ability to fold or hinge the neck portion over the top of the instrument body with an expansible sound chamber whereby to substantially reduce both the length and width of the instrument. U.S. Pat. No. 3,910,151 to L. Copeland broadly suggests an expansible stringed instrument in which the neck can be pivoted into a position resting against the rear wall of the main body of the instrument in combination with hinged frame and brace members on opposite sides of the body which can be collapsed inwardly against the main body when not in use. However, Copeland is specifically directed for guitars other than those of the acoustical variety; i.e., those containing or having a sound chamber. Again, however, it is desirable to so construct and design an acoustic guitar and other stringed instruments containing a sound chamber in such a way as to permit substantial reduction in length and width of the instrument when not in use so as to make it easy to store or carry and to do so in such a way as to require a minimum of additional parts and without detracting from the tonal qualities of the instrument.

Other representative patents are U.S. Pat. Nos. 3,396,621 to B. G. Dycus; 3,657,462 to G. D. Robinson and 4,112,804 to J. Cecchini.

SUMMARY OF THE INVENTION

It is therefore an object of the present invention to provide for a novel and improved musical stringed instrument which is collapsible into a compact unit in order to facilitate storage and transportation.

Another object of the present invention is to provide for an acoustic guitar having a collapsible sound chamber; and further wherein the guitar includes a foldable neck or fingerboard portion.

It is a further object to provide for a novel and improved collapsible sound chamber which is conformable for use with different stringed instruments, such as, acoustic guitars without detracting significantly from their playing or tonal qualities.

It is a still further object of the present invention to provide in an acoustic guitar for a collapsible sound chamber having wing sections composed of a rigid material and which are movable between an expanded position forming lateral extensions of a common center section and a collapsible position in which the wing sections form a protective cover for the center section.

It is an additonal object of the present invention to provide for a novel and improved acoustic guitar having a collapsible body in cooperation with a foldable neck section whereby to permit substantial reduction in size of the guitar for the purpose of storage or ease of transportation.

In accordance with the present invention, there has been devised in a preferred embodiment an acoustic guitar of the type having a sound board, an elongated neck extending from one end of the sound board and means for pivotally connecting the neck to the end of the sound board. As a part of that combination, a collapsible body section containing the sound board also has a center section including a top panel, a bottom panel and end walls joining the top and bottom panels together, and side wing sections form movable closures on opposite sides of the central section. Each side wing correspondingly includes top and bottom panels and a sidewall joining the wing panels together, the center section and side wings together defining a hollow enclosure, and means are provided for connecting the side wings in articulated relation to the center section for movement between an expanded position and a contracted position with respect to the center section.

Other objects, advantages and features of the present invention will become more readily appreciated and understood when taken together with the following detailed description in conjunction with the accompanying drawings, in which:

BRIEF DESCRIPTION OF THE DRAWINGS

FIG. 4 is a side elevational view of the preferred embodiment of the present invention shown in the expanded position;

FIG. 5 is a side elevational view of the preferred form of the present invention in the collapsed position;

FIG. 6 is an enlarged cross-sectional view taken about lines 6—6 of FIG. 4;

FIG. 7 is an enlarged view taken about lines 7—7 of FIG. 2;

FIG. 10 is an enlarged cross-sectional view of a modified form of neck section hold-down assembly; and FIG. 11 is a top view taken about lines 11—11 of FIG. 10.

DETAILED DESCRIPTION OF THE PREFERRED EMBODIMENT

Figures 1, 2, 3, 8, 9:
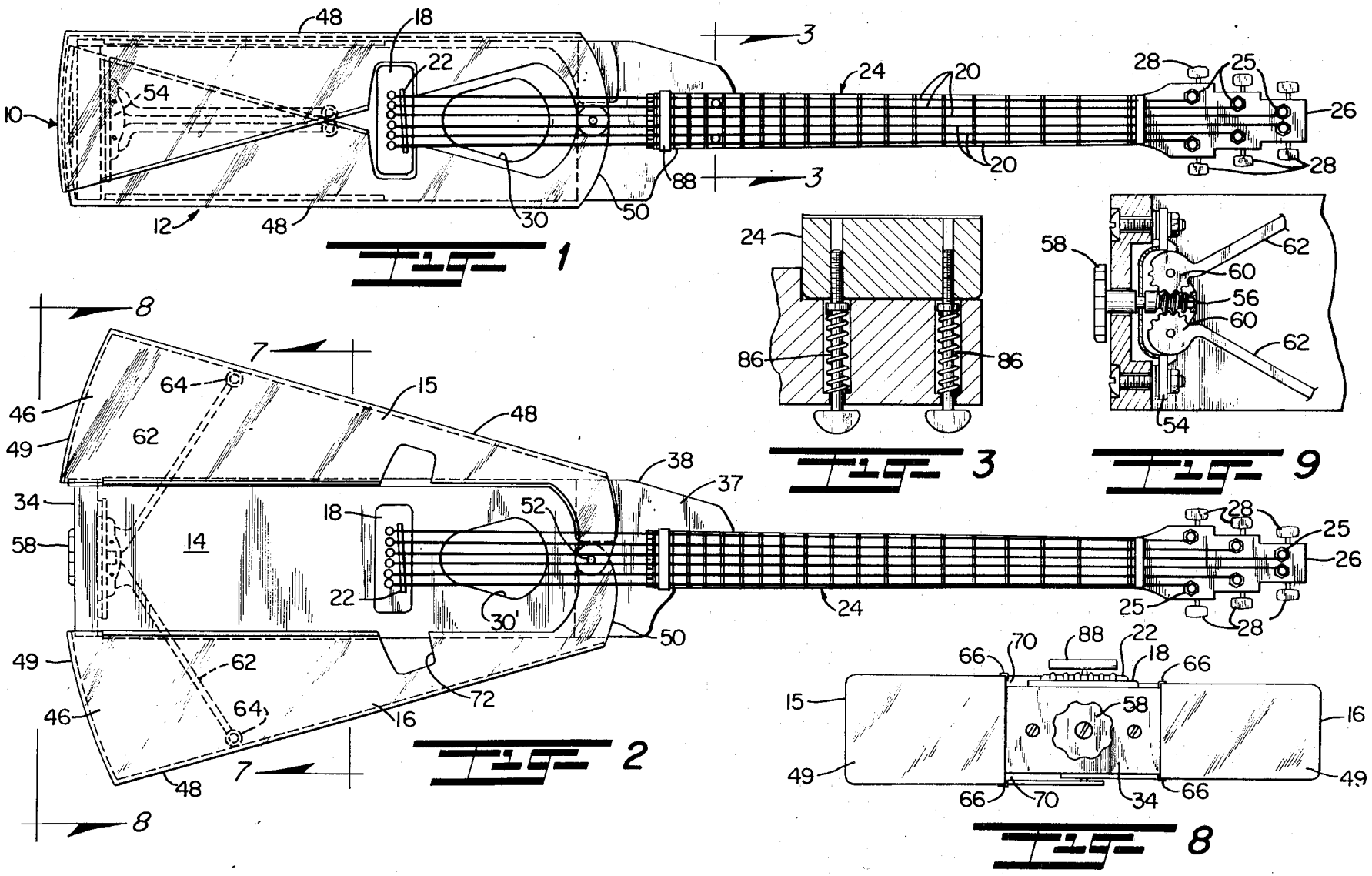
FIG. 1 is a top plan view of a preferred embodiment of the present invention illustrated with its sound chamber in a collapsed position.
FIG. 2 is a top plan view of the preferred form of instrument shown in FIG. 1 with the sound chamber in the expanded, playing position.
FIG. 3 is a cross-sectional view taken about lines 3—3 of FIG. 1.
FIG. 8 is an end view of the preferred form of the present invention with the sound chamber in the expanded position.
FIG. 9 is an enlarged fragmentary view of the expander arm mechanism of the present invention.

Referring in detail to the drawings, there is shown by way of illustrative example in FIGS. 1 to 8 a preferred embodiment of the present invention in which an acoustic guitar 10 is comprised of a body 12 having a hollow center section 14 and articulated wing sections 15 and 16. A saddle 18 is positioned at an intermediate portion of the center section 14 and serves as a mounting platform for connection of the ends of guitar strings 20 in a conventional manner. Briefly, the guitar strings 20 are anchored to the saddle 18 and are passed rearwardly over a sound bridge 22 then continue their rearward extension over a neck or fingerboard 24 and are adjustably secured at their rearward ends to a plurality of pegs 25 mounted on a peghead 26. The strings are tuned in a wellknown manner by threaded adjustment of the pegs via thumb adjustment screws 28 whereby to regulate the tension and pitch of the strings.

Considering in more detail the construction and arrangement of the guitar body 12, the center section 14 includes a top panel 30, bottom panel 32 and a front end wall 34 joining the forward ends of the top and bottom panels together. A rear end wall 36 joins the rear ends of the top and bottom panels together and is in the form of a relatively thick mounting block having a rear extension pad 37 projecting from the rearward end surface of the mounting block 36 and, as noted in the plan views of FIGS. 1 and 2, the extension pad has rearwardly tapered sides 38. Upper surface 39 of the extension pad is disposed flush with the upper surface of the top panel 30 and is provided with a shallow recessed area 40 which serves as a seating area for the underside of the neck 24. An opening 30' is formed in the top panel 30 toward the rearward end of the center section of the guitar body and aligned beneath the strings 20.

The wing members 15, 16 are so constructed and arranged as to cooperate with the center section 14 in forming a common enclosure or sound chamber as designated at 42. To this end, each wing is correspondingly comprised of top and bottom panels 44 and 45, respectively, the top and bottom panels 44 and 45 being of generally triangular configuration with wider divergent ends 46 disposed at the forward end of the center section. Top and bottom panels 44 and 45 are joined together along their outermost lateral edges by a sidewall or panel 48 and are joined together at their forward extremities by a generally convex end wall 49. Inner edges of the panels 44 and 45 are left open or spaced apart a distance such that the wing members are slightly deeper than the center section 14 and are free to advance into overlapping relation to the center section and to one another, as illustrated in FIG. 1, with the outer sidewalls 48 extending parallel and in close proximity to opposite sides of the center section 14. The rearward or narrower ends of the wing members 15 and 16 include arcuate arm members 50 which have inner free ends pivotally interconnected to one another and to the center of the top and bottom panels 30 and 32 by means of upper and lower, aligned pivot pins 52 and 53, respectively. It will be noted that the pivot pins extend through the top and bottom panels 30 and 32 and into the mounting block 36 at the rear end of the center section to provide a firm anchor or means of connection of the wing members.

An expander mechanism 54 is mounted on the end wall 34 of the center section 14 and, as shown in FIG. 9, comprises a threaded stem or worm 56 projecting through the thickness of the end wall 34, the stem having an enlarged head 58 which can be manually grasped to rotate the stem. The inner end of the stem projects beyond the inner surface of the end wall to intermeshingly engage diametrically opposed tooth elements 60 at the inner ends of a pair of expander arms 62. The expander arms have their inner ends pivotally secured to mounting bracket 64 on the inner surface of the end wall 34 and roller members 64 are positioned at the outer ends of the expander arms 62. Rotation of the stem 56 and engagement with the teeth 60 will cause the arms 62 to move from a position extending substantially parallel to one another within the center section, as illustrated in FIG. 1, to a spread position as shown in FIG. 2 with the rollers 64 engaging the sidewalls 48 of the wings. Thus, the expander arms 62 are operative to diverge away from one another into engagement with the sidewalls 48 of the wings 15 and 16 and to cause them to expand outwardly away from the collapsed position shown in FIG. 1 to the expanded position shown in FIG. 2; and in the expanded position the expander arms will serve to brace or hold the wings in the expanded position. Threading of the stem 56 in an opposite direction will cause retraction of the arms away from the sidewalls 48, and the wing members are free to collapse inwardly about the pins 52 and 53.

In order to limit outward expanding movement of the wing members 15, 16 with respect to the center section 14, the inner free edges of the top and bottom wing panels 44 and 45 are provided with generally U-shaped closure strips 66 extending along their length forwardly of slotted portions 72, as seen in FIGS. 2 and 7, each strip including a return portion 67 nearest the center section panels which is spaced slightly from the wing panel to form a slight clearance slot. In turn, the center section top and bottom panels 30 and 32 have L-shaped closure strips 68 coextensive with strips 66, each provided with a return portion 69 spaced slightly from its associated panel surface to form an oppositely directed clearance slot with respect to those on the wing panels. When the wing panels are expanded by the expander arms 62, the return portions 67, 69 of the respective wing panels 15, 16 and center section 14 will enter into the clearance slots formed by the other strip so as to establish close-fitting engagement between the wing panels and center section in the expanded position. In this relation, it will be noted that the center section is provided with shoulder 70 on opposite top and bottom panels 30 and 32 to compensate for the difference in depth of one wing section with respect to the other so that when collapsed the deeper, lefthand wing section is free to overlap the shallower, righthand wing section as shown in FIG. 7 so as to be free to move into overlapping relationship as shown in FIG. 1. Moreover, open slotted portions 72 are formed in each of the wing members in aligned relation to the saddle 18 so that the wing members will clear the saddle in moving into the contracted position.

Neck section 24 is of narrow, elongated generally rectangular configuration and generally constitutes a fingerboard of standard or conventional construction, except for its manner of hinging to the guitar body for movement from an extended position as shown in FIG. 1 to a folded position shown in FIG. 5 in which the neck portion overlies the body of the guitar. For this purpose, the neck section 24 is hinged to the rear end wall 36 of the body by means of a hinge 80 having a lower leaf 82 which is mounted to project upwardly from the juncture of the end wall 36 and extension pad 37. An upper hinge leaf 83 is affixed to the forward end of the neck section 24 with the hinge or pivot pin 84 between the leaves 82 and 83 aligned just above the top surface of the saddle 18 so that the neck portion is free to extend or fold over the top of the guitar body substantially parallel to the top panel 30. In the extended position, the underside of the neck section rests in the recessed portion 40 of the extension pad so as to once again extend substantially parallel to the top panel 30 of the body. A pair of set screws 86 extend upwardly through aligned bores in the extension pad and neck portion to retain the neck section 24 in the extended position.

In order to prevent crimping of the strings and to maintain their proper alignment in the folded position, a circular bar 88 extends transversely across the forward edge of the fingerboard over the strings 20 adjacent to the pivot pin 84 so that the strings 20 are caused to curve over the roller bar, as shown in FIG. 5, when the neck section 24 is folded into the storage position. Preferably, the bar 88 is supported in spaced relation above the strings 20 by means of a downwardly directed stem 89 which is spring-loaded by a coiled spring 90. Spring 90 is mounted within a counterbore 92 in the neck section 24 between a stop element 93 and a shoulder 94 at one end of the counterbore and urges the circular bar 88 in a direction away from the strings 20 so as to space the bar above the strings when the neck is in the extended position as shown in FIG. 4. However, when the neck section 24 is folded over the guitar body, the bar 88 is pressed downwardly against the urging of the spring 90.

A modified form of hold-down mechanism for the neck section 24 is illustrated in FIGS. 10 and 11 wherein a disk 95 is mounted with its upper surface flush with a shallow recess 40' in the extender pad 37', the disk including a stem 96 extending downwardly through a bore in the extender pad 37, and a handle 97 is fastened to the end of the stem 96 by suitable fastener 98. The disk 95 has a pair of diametrically opposed, arcuate slots 100, each slot provided with an enlarged entrance 102 at opposite ends, as illustrated in FIG. 11. A pair of set screws 104 are threadedly connected into the underside of the neck section 24, each set screw having an enlarged head 105 projecting downwardly from the undersurface of the neck section. The screws 104 are disposed transversely of the length of the neck section in alignment with the arcuate slots 100. Rotation of the handle 97 will cause the entrances 102 in the disk 95 to move into alignment with the set screws 104 so that the heads 105 will pass through the entrances. Rotation of the disk 95 in the opposite direction will then cause the heads 105 to move through enlarged recesses 106 beneath the slots, as shown in dotted form in FIG. 11, to securely retain the neck section in the extended position. If desired, the enlarged recesses 106 may be increased in depth slightly along the length of their path thus drawing the screw heads 105 down with increasing force as the handle 97 is turned. The reverse procedure is followed to permit the heads to be removed from the arcuate slots when desired to fold the neck section 24 into the storage position shown in FIG. 5.

It will be evident from the foregoing description of preferred and modified forms of the present invention that a novel and improved collapsible guitar construction has been devised. Of particular importance, the expandible body section of the guitar comprising the cooperating wing sections 15, 16 and center section 14 form a common sound chamber to enhance the tonal qualities of the guitar. When not in use, the wing sections are foldable laterally from the position shown in FIG. 2 to the collapsed position shown in FIG. 1 so as to result in an extremely compact unit for transportation or storage purposes. Similarly, the neck section 24 can be folded over the body section by the simple expedient of loosening the strings, then releasing the set screws 86 and hinging the neck section into the folded position shown in FIG. 5. If desired, a suitable latch mechanism can be used to retain the wing sections in the folded position of FIG. 1; or return springs may be incorporated into the pivot pins 52 and 53 to urge the wing sections to normally return to the contracted position of FIG. 1. In the latter event, the expander arm 62 will overcome the urging of the springs to force the wing sections to the expanded position of FIG. 2. Materials customarily employed in the construction of conventional guitars may be used for the neck section 24 and center section 14 as well as for the saddle 18, bridge 22 and peghead 26. Most desirably, the wing sections 15 and 16 are composed of plexiglas, Fiberglas, metal or plastic materials with metal, Teflon or plastic closure strips 66 and 68 between the inner edges of the wing sections and opposite sides of the center section. Thus, the wing sections are of a rigid material and in the collapsed position will serve as a protective covering for the center section itself.

It is therefore to be understood that while preferred and alternate forms of the present invention have been herein set forth and described, various modifications and changes may be made in the construction and arrangement of parts thereof without departing from the spirit of the present invention as defined by the attached claims.

I claim:

1. In a stringed musical instrument having a sound board, an elongated fingerboard extending from one end of said sound board and means for pivotally connecting said fingerboard to said sound board, the combination therewith comprising:

a body section containing said sound board, said body section having a center section including a top panel, a bottom panel and end walls joining said top and bottom panels together, and side wing sections forming movable closures on opposite sides of said central section, each said side wing section correspondingly including top and bottom panels and a sidewall joining said wing panels together, said center section and side wings together defining a hollow enclosure, and means for connecting said side wings in articulated relation to said center section.

2. In a stringed instrument according to claim 1, said wing sections movable between a position in overlapping relation to said center section with said sidewalls of said wing sections extending along opposite sides of said center section and an expanded position in which inner free edges of said side wings opposite to said sidewalls are disposed along opposite sides of said center section.

3. In a stringed instrument according to claim 1, said means for connecting said side wing members to said center section including pivot means pivotally interconnecting one end of each side wing member to said body section.

4. In a stringed instrument according to claim 3, said pivot means pivotally interconnecting said ends of said side wings to one another and to said center section.

5. In a stringed instrument according to claim 1, said connecting means defined by pivot means disposed at one end of said sound board adjacent to said fingerboard.

6. In a stringed instrument according to claim 1, including threadedly adjustable expansion means movable into engagement with said side wing members to brace said side wing members in the expanded position.

7. In a stringed musical instrument having a sound board, an elongated neck and fingerboard extending from one end of said sound board and means for pivotally connecting said neck to said sound board, the combination therewith comprising:

a collapsible sound chamber including a center section containing said sound board along an upper surface thereof, and articulated side wing sections including means for connecting said side wing section to said center sections for movement between a contracted position superimposed with respect to said center section and an expanded position in which said side wing sections diverge away from said center section to substantially increase the size of said sound chamber.

8. In a stringed instrument according to claim 7, said center section and side wing sections forming a substantially airtight, common enclosure in the expanded position.

9. In a stringed instrument according to claim 8, including pivot means pivotally interconnecting said center section and said side wing sections together adjacent to said pivotal connection between said neck and said center section.

10. In an acoustic guitar having a sound board, an elongated neck at one end of said sound board and means for pivotally connecting said neck a body section containing said sound board, and side wing portions forming movable closures on opposite sides of said body, each said side wing correspondingly including triangular top and bottom panels and a sidewall joining said panels together, said body section and side wings together defining a hollow enclosure, and means for connecting said side wings in articulated relation to said body section.

11. In a guitar according to claim 10, said wing sections movable between a position in overlapping relation to said body section with said sidewalls of said wing members extending along opposite sides of said body section and an expanded position in which inner free edges of said wing sections opposite to said sidewalls are disposed along opposite sides of said body section.

12. In a guitar according to claim 10, said means for connecting said side wing members to said body section including pivot means pivotally interconnecting one end of each wing section to said body section with said wing members diverging away from said body section in the expanded position.

13. In a guitar according to claim 12, said pivot means pivotally interconnecting said ends of said wing sections to one another and to said body section, and threadedly adjustable expansion means movable into engagement with said side wing members to brace said side wing sections in the expanded position.

14. In a guitar according to claim 10, said body section being of hollow enlongated configuration having a top panel, a bottom panel and end walls joining said top and bottom panels together, expansion arms positioned within said body section and means for urging said expansion arms laterally into engagement with said sidewalls of said wing section to brace said wing sections in the expanded position.

15. In a guitar according to claim 10, including hold-down xeans for releasably securing said neck section in extended planar relation to said sound board.

16. In a guitar according to claim 15, said body section including one end wall in the form of a mounting block adjacent to said neck section, said mounting block including an extension pad provided with a shallow recess for insertion of said neck portion in the extended position.

17. In a guitar according to claim 16, said hold-down means defined by a disk provided with arcuate slots therein, means for rotating said disk, downwardly directed projections on said neck section including enlarged heads alignable with said arcuate slots when said neck section is disposed in said recessed portion whereby rotation of said disk will urge said enlarged heads into connected relation to said disk.

* * * * *

UNITED STATES PATENT AND TRADEMARK OFFICE

CERTIFICATE OF CORRECTION

PATENT NO. : 4,686,882

DATED : 18 August, 1987

INVENTOR(S) : Shaw, Eric D.

It is certified that error appears in the above—identified patent and that said Letters Patent is hereby corrected as shown below:

CLAIM 10

Column 7 Line 46 After "neck", insert -- to said sound board, the improvement comprising: --

Signed and Sealed this

Nineteenth Day of January, 1988

*Attest:*

DONALD J. QUIGG

*Attesting Officer*

*Commissioner of Patents and Trademarks*